US010247396B2

(12) United States Patent
Johnson et al.

(10) Patent No.: US 10,247,396 B2
(45) Date of Patent: Apr. 2, 2019

(54) ROTATABLE OPTICAL ASSEMBLIES FOR HIGH MAST LUMINAIRE

(71) Applicant: GE Lighting Solutions, LLC, East Cleveland, OH (US)

(72) Inventors: David Mark Johnson, Hendersonville, NC (US); Kenneth Alden Lane, Brevard, NC (US)

(73) Assignee: GE Lighting Solutions, LLC, East Cleveland, OH (US)

( * ) Notice: Subject to any disclaimer, the term of this patent is extended or adjusted under 35 U.S.C. 154(b) by 129 days.

(21) Appl. No.: 15/217,603

(22) Filed: Jul. 22, 2016

(65) Prior Publication Data

US 2018/0023790 A1 Jan. 25, 2018

(51) Int. Cl.

| | |
|---|---|
| ***F21V 21/30*** | (2006.01) |
| ***F21S 8/08*** | (2006.01) |
| ***F21V 31/00*** | (2006.01) |
| *F21V 29/76* | (2015.01) |
| *F21V 23/00* | (2015.01) |
| *F21V 17/12* | (2006.01) |

(52) U.S. Cl.

CPC ..... *F21V 21/30* (2013.01); *F21S 8/088* (2013.01); *F21V 31/005* (2013.01); *F21V 17/12* (2013.01); *F21V 23/002* (2013.01); *F21V 29/763* (2015.01)

(58) Field of Classification Search

CPC ..... F21S 8/088; F21V 21/30; F16M 11/08; F16M 11/2014

USPC ..... 248/323, 342

See application file for complete search history.

(56) References Cited

U.S. PATENT DOCUMENTS

| | | | | |
|---|---|---|---|---|
| 5,806,956 | A * | 9/1998 | Hyun-Jo | B60Q 1/245 362/272 |
| 9,795,003 | B2 | 10/2017 | Johnson | |
| 2012/0307486 | A1* | 12/2012 | Gordin | F21V 7/0025 362/223 |
| 2013/0008094 | A1* | 1/2013 | Wood | B61L 5/1863 52/40 |
| 2013/0272019 | A1* | 10/2013 | Engstrom | F21V 21/03 362/581 |
| 2015/0078012 | A1* | 3/2015 | Delano | F21S 8/02 362/365 |

OTHER PUBLICATIONS

Disclosed Anonymously, Rotatable Optics for High Mast Lighting, ip.com No. IPCOM000245400D, Mar. 7, 2016, 5 pages, USA.

* cited by examiner

*Primary Examiner* — Julie A Bannan

(74) *Attorney, Agent, or Firm* — Peter T. DiMauro; GPO Global Patent Operation

(57) ABSTRACT

There are provided systems and methods for use with high mast luminaires. For example, there is provided a lighting system that can include a mounting portion and an optical assembly attached to the mounting portion via a rotatable platform. The light system can further include a stop disposed inside the mounting portion, and the stop can be configured to permit a rotation of the optical assembly and to limit the rotation to an angle greater than 360 degrees.

5 Claims, 5 Drawing Sheets

ROTATABLE OPTICAL ASSEMBLIES FOR HIGH MAST LUMINAIRE

TECHNICAL FIELD

The present disclosure relates to high mast luminaires. More particularly, the present disclosure relates to rotatable optical assemblies for high mast luminaires.

BACKGROUND

A high mast luminaire is a lighting system that includes one or more lighting fixtures mounted on top of a pole. A lighting fixture is typically positioned so as to illuminate a specific area of a roadway or recreational field. During deployment or servicing, positioning the lighting fixture includes turning an optical enclosure of the fixture to aim it in a desired direction. The optical enclosure, also referred to as the "optical assembly," can include a plurality of mirrors and light sources, as well as wires, bolts, screws, and the like.

When positioning the optical assembly, the parts included in the assembly, especially the wires and the bolts have to be repositioned in order to avoid excessive stresses on these parts. For example, regulatory requirements postulate that some wires may not be turned more than 370 degrees when positioning an optical assembly. As such, sufficient care must be taken in order to meet this requirement.

Positioning is typically carried by opening the optical enclosure to reconfigure the parts in order to make sure that no damages occur during rotation. Consequently, repositioning an optical assembly is thus time-consuming and cumbersome, as it requires an elaborate and careful process that requires opening the lighting fixture to manually reconfigure its components.

SUMMARY

The embodiments featured herein help solve or mitigate the above noted issues as well as other issues known in the art. For example, with the aid of some of the embodiments, a high mast optical assembly can be aimed and locked at a desired position without having to open the optical enclosure prior to positioning. Some embodiments can provide the capability to rotate the optical assembly while providing a feature that can stop the rotation at a predetermined limit, in order to meet regulatory requirements. Furthermore, some embodiments can provide the ability to rotate the optical assembly without having to reposition parts and wires, thus rendering aiming a luminaire in a desired position simple and safe.

One embodiment can provide a lighting system that can include a mounting portion and an optical assembly attached to the mounting portion via a rotatable platform. The light system can further include a stop disposed inside the mounting portion, and the stop can be configured to permit a rotation of the optical assembly and to limit the rotation to an angle greater than 360 degrees.

Another embodiment can provide a method for rotating an optical assembly attached to a mounting portion of a lighting system via a rotatable platform. The method can include providing a stop disposed inside the mounting portion. The method can further include causing, by actuating the platform, a rotation of the optical assembly. The rotation can be limited to an angle greater than 360 degrees.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

Figure 1:
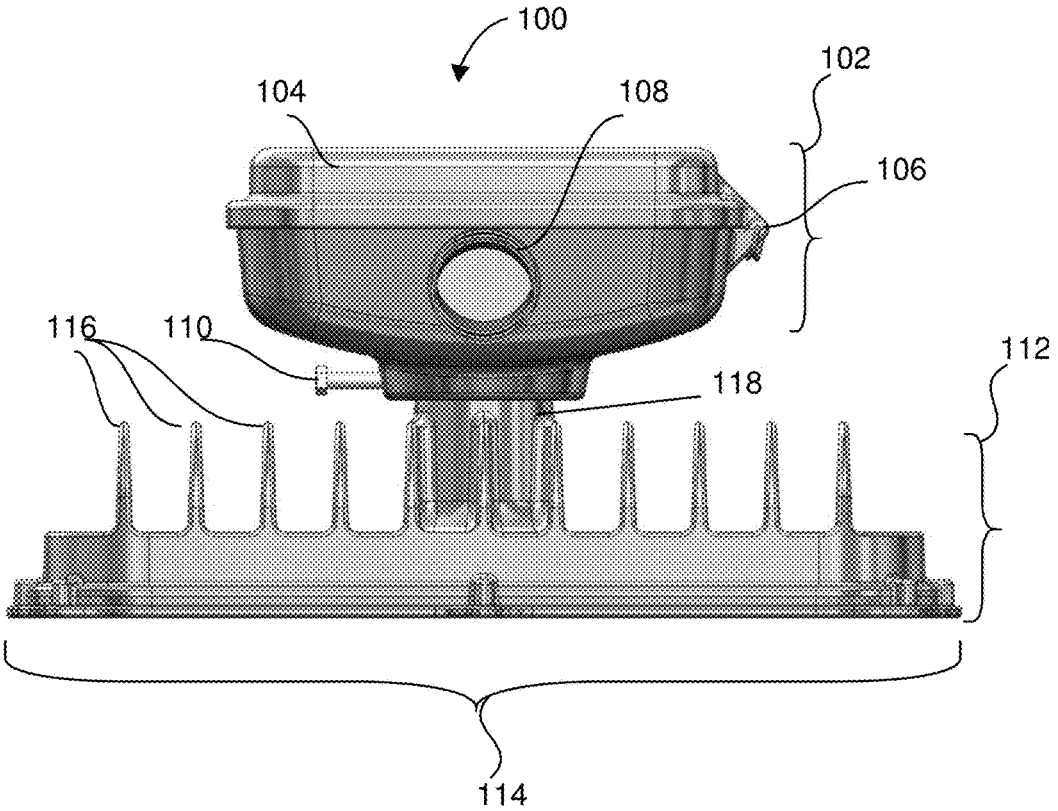
FIG. 1 illustrates an aspect of the subject matter in accordance with one embodiment.

FIG. 1 illustrates a high mast luminaire 100 including a mounting portion 102 and an optical assembly 112. The optical assembly 112 can include a bottom surface 114 from which light can emanate. Furthermore, the optical assembly 112 can include a plurality of fins 116 configured to provide thermal management for dissipating heat from the light sources (not shown) included within the optical assembly 112.

The mounting portion 102 can be an electrical enclosure that includes a plurality of components that individually or cooperatively provide electrical and mechanical functionality to the luminaire 100. For example, and not by limitation, the mounting portion 102 can include power supplies, signal conditioning circuitry, metering circuitry for monitoring power consumption in the luminaire 100, and a reconfigurable stop for limiting the rotation of the optical assembly 112, as shall be described in greater detail below.

The mounting portion 102 can include a cover 104 mounted on a hinge 106. The cover 104 can be opened to provide access to the parts included in the mounting portion 102. Furthermore, on a side wall of the mounting portion 102, there can be located a hole 108 that is configured for attachment to a high mast mounting arm. The mounting portion 102 can further include a hole configured to receive a mounting post 118 that is immovably affixed, or movably affixed in other embodiments, to the optical assembly 112.

The hole can have a rim and it can be a threaded so that it can receive a set screw 110. Once the mounting post 118 is inserted in the hole at one end, the set screw 110 can be actuated to secure the optical assembly 112 to the mounting portion 102.

In the luminaire 100, the optical assembly 112 can rotate to at least 360 degrees, and it can be locked in a desired position using the set screw 110. Adjustment of the angle of rotation about the nadir axis can be facilitated by graduations on the optical enclosure and a reference marker on the mounting portion 102. Alternatively, the graduations could be placed on the mounting post 118 or a suitable fixture attached thereto. In other embodiments, the graduations and the reference markers could be interchanged between the optical assembly 112 and the mounting portion 102.

Figure 2:
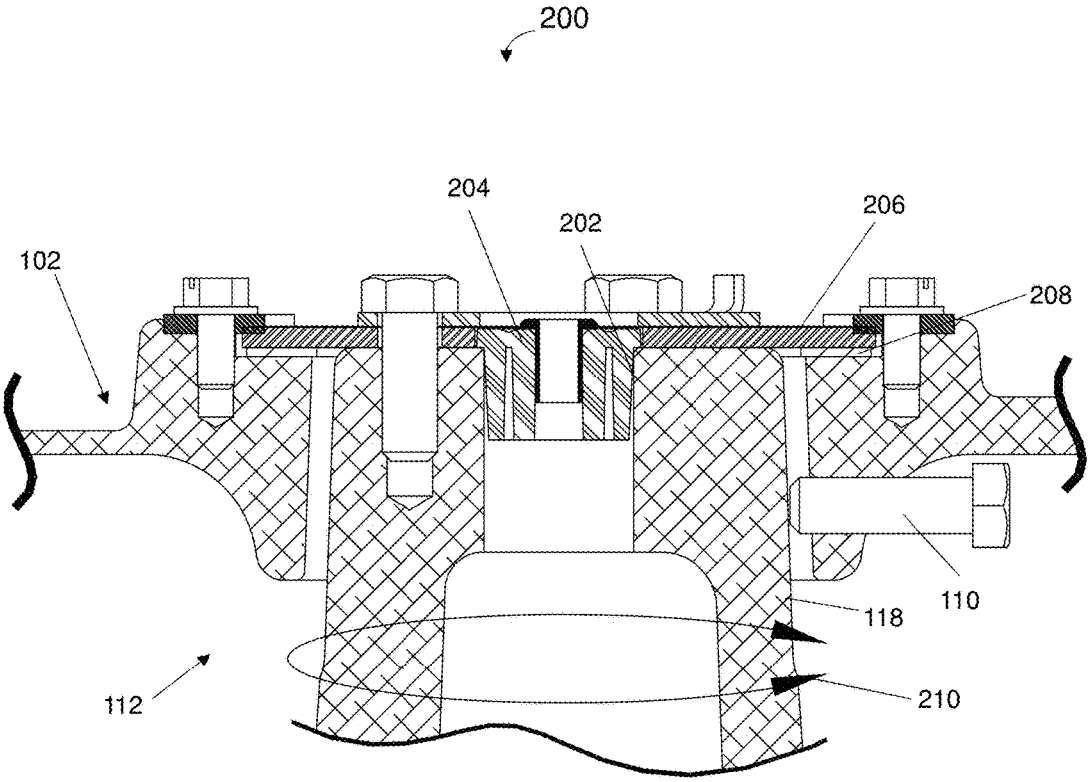
FIG. 2 illustrates an aspect of the subject matter in accordance with one embodiment.

FIG. 2 illustrates a cross-sectional view 200 of the mounting portion 102, along with a portion of the optical assembly 112, namely the mounting post 118 with which the optical assembly 112 is secured on the mounting portion 102. FIG. 2 shows a sealing arrangement of the mounting portion 102 and the optical assembly 112 for protecting the luminaire 100 against moisture. The mounting post 118 enters the mounting portion 102 through a reinforced bearing portion and is fixed in vertical position by a plate. When the optical assembly 112 is to be rotated, the set screw 110 could be released and the optical assembly 112 can be turned in a direction 210, for example. Turning the optical assembly 112 can also be effected in the direction opposite to the direction 210.

The top end of the mounting post 118 within the electrical enclosure is protected against moisture ingress by a grommet or rubber plug 204 with means for the electrical wiring 202 to pass through. Sealing is also provided by a gasket 208 and plate 206 placed between the bearing portion and fasteners screwing into the end/top of the mounting post 118.

It is noted that while FIG. 1 shows only one lighting fixture, in other embodiments, the mounting post 118 can be attached to one or more other optical assemblies which may be similar to optical assembly 112. In these embodiments, secondary connectors orthogonal to the mounting post 118 can be used to connect the several optical assemblies to the mounting post 118, and rotation of all the optical assemblies can be effected simultaneously.

Figure 3:
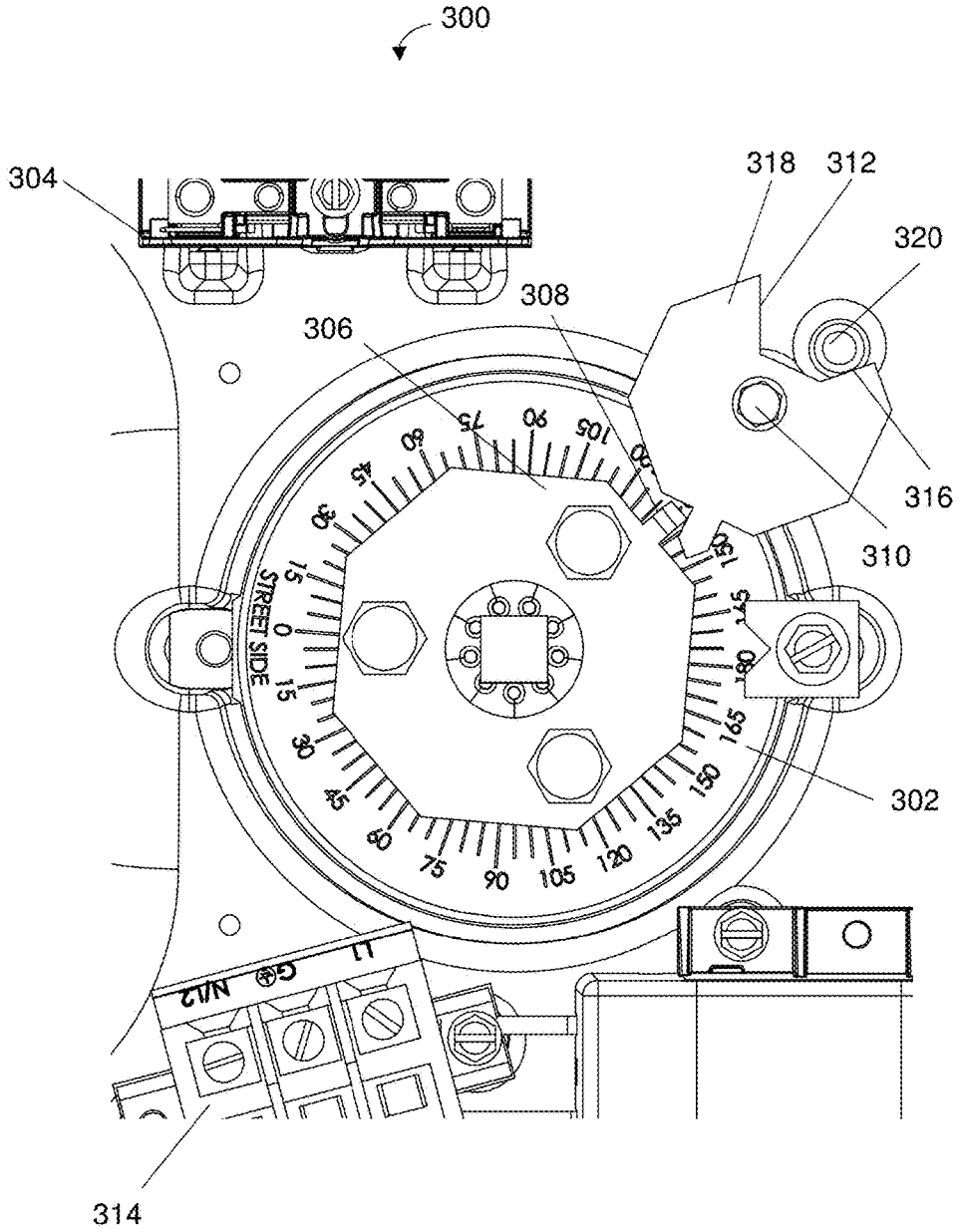
FIG. 3 illustrates an aspect of the subject matter in accordance with one embodiment.

FIG. 3 illustrates an inner view 300 of the mounting portion 102. As previously, mentioned, the mounting portion 102 can include a plurality of electrical components, of which electrical components 304 and 314 are shown. The mounting portion 102 can include a rotatable plate 302. The mounting post 118 can be secured onto the rotatable plate 302 and a fixture 306 with fasteners, thus securing the mounting post 118 to the mounting portion 102, but allowing rotation about a rotational axis.

The fixture 306 can include a tab 308 that protrudes from the side of the rotatable plate 302. The mounting portion 102 can further include, placed adjacent to the rotatable plate 302, a stop 318 that can engage the tab 308 to stop the rotatable plate 302 from rotating.

The stop 318 can be reconfigured to provide predetermined limits for rotation. For example, the stop 318 can be repositioned at an angle between edges 312 and 316 by adjusting the distance between the edges 312 and 316. As such, when rotating, the tab 308 can push against the stop 318 to make it pivot around a screw 310, but rotation will be stopped when either one of edge 312 or edge 316 hits a pillar 320. The distance between the edges 312 and 316 can be preselected at manufacture to provide a predetermined limit for rotation.

Figure 4:
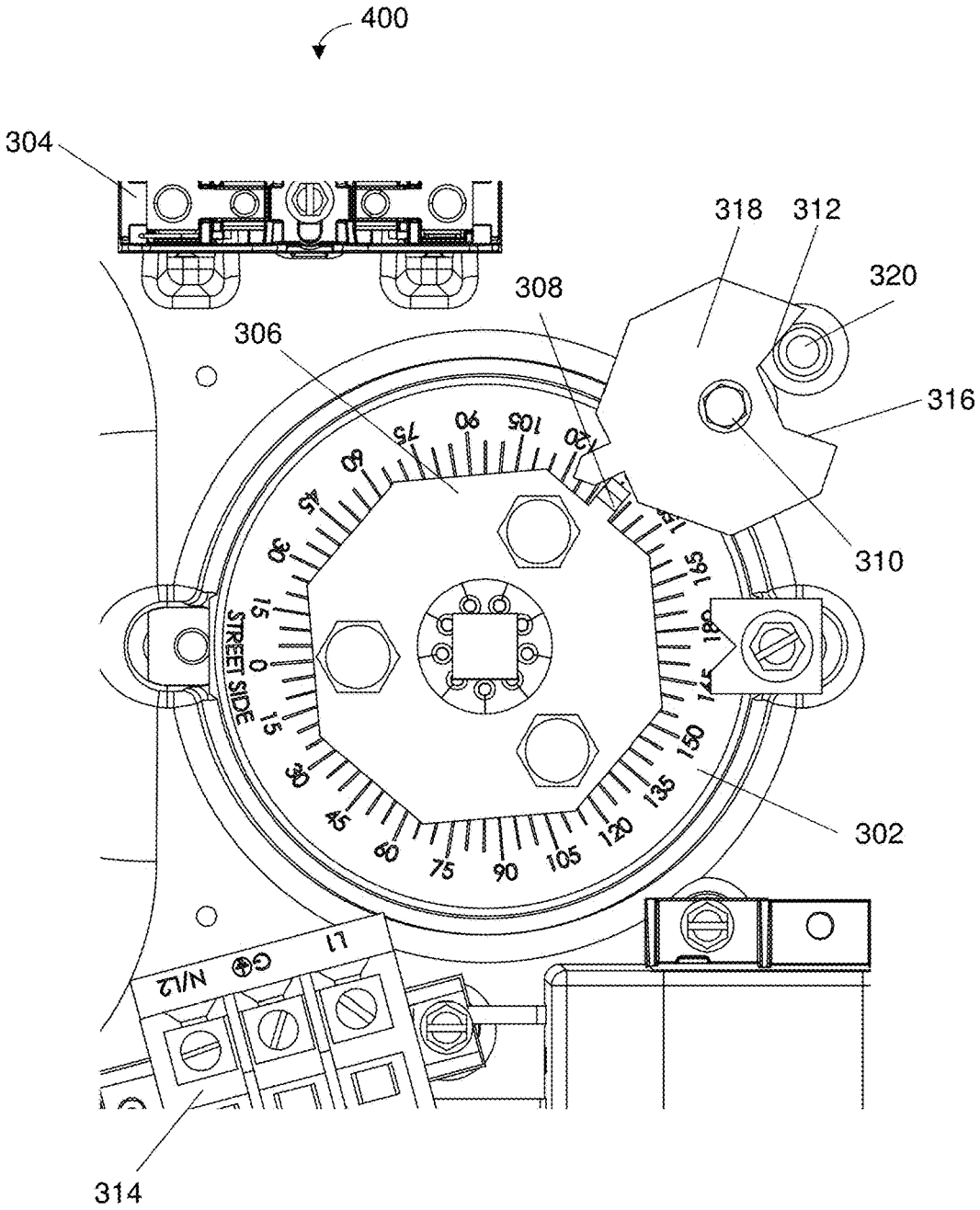
FIG. 4 illustrates an aspect of the subject matter in accordance with one embodiment.

As is shown in FIG. 4 in the inner view 400, the rotatable plate 302, and hence the optical assembly 112 can be rotated by at least 360 degrees, but the rotation is stopped when the edge 312 of the stop 318 hits pillar 320. In the exemplary embodiments shown, (i.e. in FIGS. 3 and 4), rotation is limited to about 370 degrees. Other predetermined limits for rotation are contemplated and can be effected by appropriately selecting the angles between the edges 312 and 316. This can be accomplished by replacing the stop 318.

Figure 5:
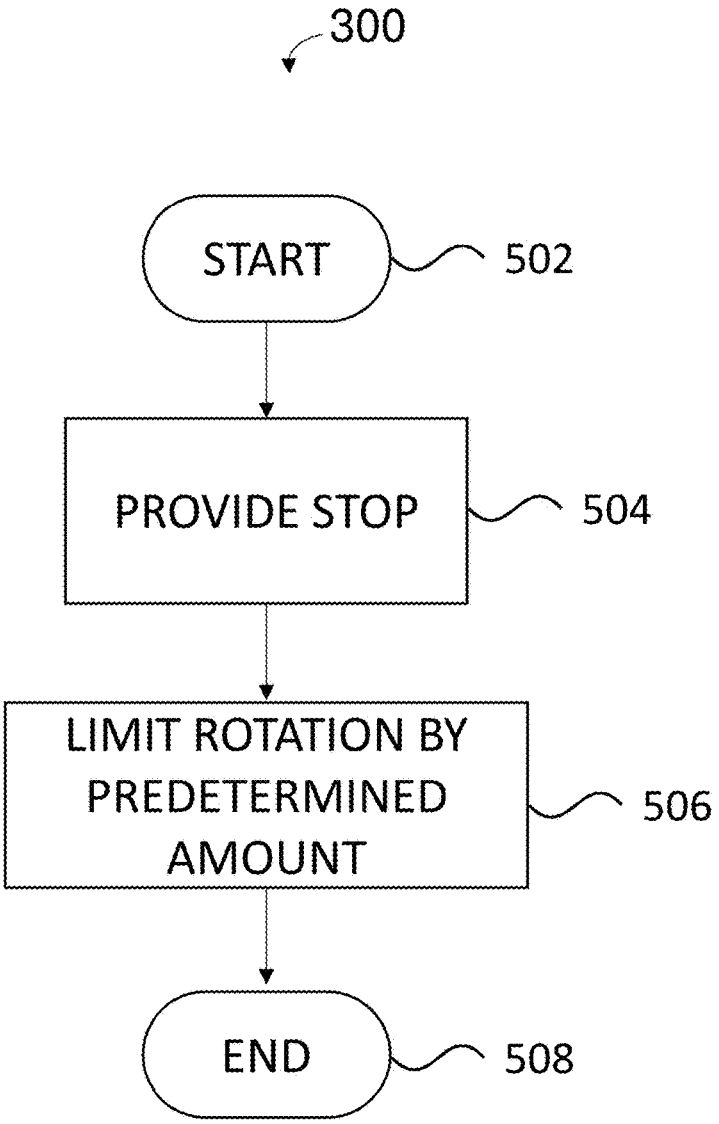
FIG. 5 illustrates a method in accordance with one embodiment.

Having set for various embodiments, a method 500 consistent with their operation is now described with respect to FIG. 5. The method 500 can begin at a block 502, and it can include providing a stop disposed inside a mounting portion of high mast lighting system (block 504). When a rotation is effected by actuating (i.e. causing the platform to turn), the stop can prevent the rotation from going beyond a predetermined limit (block 506). In some embodiments the rotation can be at least 360 degrees and the predetermined limit of rotation can be about 370 degrees. The method 500 can end at a block 508. Furthermore, it is noted that in the above described embodiments, the direction of the rotation can be arbitrary (i.e. counter-clockwise or clock-wise), and the stop can be configured to provide arbitrary limits to rotation. For example, a stop can be configured to allow the optical assembly to rotate by no more than 60 degrees, i.e. to turn along an arc that is less than 360 degrees.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. A lighting system, comprising:

a mounting portion;

an optical assembly attached to the mounting portion via a rotatable platform;

a stop disposed inside the mounting portion, the stop being configured to permit a rotation of the optical assembly and to limit the rotation to an angle greater than 360 degrees, wherein the stop rotates about a pivot screw and the rotation of the stop is limited by edges of the stop contacting a fixed pillar; and wherein the rotatable platform includes a tab configured to engage the stop, the tab protruding from a side of the rotatable platform, wherein the tab is rotatable around a rotation axis to engage the stop; and wherein the lighting system is configured to allow adjustment to the rotation from outside the lighting system.

2. The lighting system of claim 1, wherein the rotation of the optical assembly is at least 360 degrees.

3. The lighting system of claim 1, wherein the angle is about 370 degrees.

4. The lighting system of claim 1, wherein the stop is disposed adjacent to the rotatable platform.

5. The lighting system of claim 1, wherein the tab is configured to engage either side of the stop.

* * * * *